United States Patent [19]

Fratty

[11] 4,351,018

[45] Sep. 21, 1982

[54] LAMP WITH STEPPED REFLECTOR SURFACE CONTAINING VERTICAL RIBS

[75] Inventor: Hector Fratty, Boulogne, France

[73] Assignee: Cibie Projecteurs, Bobigny, France

[21] Appl. No.: 162,503

[22] Filed: Jun. 24, 1980

[30] Foreign Application Priority Data

Jun. 29, 1979 [FR] France ..... 79 16926

[51] Int. Cl.[3] ..... F21M 3/08

[52] U.S. Cl. ..... 362/215; 362/304; 362/310; 362/346; 362/348; 362/350

[58] Field of Search ..... 362/297, 299, 300, 310, 362/346, 347, 348, 350, 304, 215

[56] References Cited

U.S. PATENT DOCUMENTS

| | | | |
|---|---|---|---|
| Re. 17,825 | 10/1930 | Linton et al. | 362/348 |
| 2,174,937 | 10/1939 | Dietz | 362/346 |
| 3,688,149 | 8/1972 | Pitkjaan | 362/297 X |
| 4,143,412 | 3/1979 | Sassmannshausen | 362/297 |
| 4,149,229 | 4/1979 | Draper | 362/346 X |
| 4,225,903 | 9/1980 | Buchleitner | 362/346 X |
| 4,277,821 | 7/1981 | Sassmannshausen | 362/346 |

*Primary Examiner*—Peter A. Nelson
*Attorney, Agent, or Firm*—Alan H. Levine

[57] ABSTRACT

In a motor vehicle headlamp or the like, the required distribution of the light rays is achieved entirely by selecting an appropriate configuration for the reflector; the front glass is a plain glass having smooth front and rear surfaces. The reflector surface is, as far as possible, a plain paraboloidal surface, but is provided with elongate ribs in selected zones, to produce a spreading of the light rays reflected from these ribs; the light is spread transversely to the length of the ribs. The reflector surface also has offset portions which, like the basic reflector shape, are paraboloidal, but have their focus or foci displaced from the focus of the basic reflector shape.

12 Claims, 19 Drawing Figures

LAMP WITH STEPPED REFLECTOR SURFACE CONTAINING VERTICAL RIBS

FIELD OF THE INVENTION

This invention relates to lamps of the type comprising a generally concave, paraboloidal reflector, a front glass secured to the front opening of the reflector, and, mounted within the enclosure formed by the reflector and the front glass, at least one light source, normally an incandescent light bulb. Such lamps are commonly used as headlamps for motor vehicles.

THE PRIOR ART

In a common construction of a motor vehicle headlamp, a twin filament bulb is used, having a main-beam filament slightly to the rear of the focus of the reflector and a dipped-beam filament slightly in front of the focus. The light rays reflected by the reflector are then redistributed somewhat by the front glass, which is provided with optical deflecting elements for this purpose. In this way, it is possible for the headlamp to produce a main beam and a dipped beam which have the required characteristics; without the redistribution of the light which is produced by the front glass, this would not otherwise be possible with a plain paraboloidal reflector.

The reflector has most commonly been made as a sheet-metal pressing. This means that the reflector can have only a fairly simple shape, either a plain paraboloid as described above, or a number of interconnected paraboloidal sectors, as disclosed in French Pat. No. 1,271,102. However, with the development of plastics materials having good mechanical strength, good heat resistance and good molding properties, it is now possible to mold a reflector in such a plastics material, and then form a reflecting surface by applying a metal coating, such as an aluminum coating, to the molding. Such a method of making a reflector allows the designer greater freedom in deciding the required shape of the reflector.

In U.S. Pat. Nos. 3,700,883 and 3,710,095, headlamps have already been proposed in which the front glass plays no part in achieving the correct distribution of light, but is instead a plain glass having smooth front and rear surfaces. In these headlamps, the reflector is no longer paraboloidal, but instead comprises a considerable number of reflecting facets. To determine an optimum arrangement for such facets, a complex computer program is required; such a program may take a number of forms, each giving a different arrangement of facets. The particular arrangements of facets disclosed in the above-mentioned U.S. patents depart considerably from a paraboloidal form. Having decided on the arrangement of facets which is required, it is then necessary to construct a mold for manufacturing the reflector, and, in view of the complex arrangement of facets, this also presents considerable problems.

It is an object of the present invention to provide a lamp, especially a motor vehicle headlamp, in which the front glass has smooth front and rear surfaces, so that the front glass is cheap and easy to produce, while the reflector has a basically paraboloidal surface, modified only to the extent that is necessary to achieve the required illumination patterns. In this way, the manufacture of a mold for producing the reflector is not made much more difficult that the manufacture of a plain paraboloidal mold.

SUMMARY OF THE INVENTION

According to one aspect, therefore, the present invention resides in the provision, in a lamp of the type comprising a reflector having a generally concave reflecting surface whose general shape is defined by the revolution of a parabola about an axis coinciding with the axis of symmetry of the parabola, and a front glass secured to the reflector to define, with the reflector, an enclosure within which at least one light source is mounted, of the improvement comprising:

providing on the reflecting surface of the reflector at least one light-spreading configuration, the said light-spreading configuration occupying a relatively narrow, elongate area of the reflecting surface, and having a cross-section, when seen as intersected at any position along the length of the said configuration by a plane lying parallel to the said axis and transverse to the length of the light-spreading configuration, which cross-section deviates from the general shape of the reflecting surface, to provide reflecting surface portions which reflect light from the light source in various directions angularly spaced apart from one another in a direction transverse to the length of the light-spreading configuration.

More specifically, the cross section of the light-spreading configuration is a curve, and may be convex towards the light source, so that the light-spreading configuration has the form of a rib standing proud of the basic paraboloidal shape of the reflector. Preferably, the cross-section of the light-spreading configuration is the same at all positions along the length of the light-spreading configuration; this should simplify the manufacture of the mold.

The reflector may have one or more groups of light-spreading configurations, with the light-spreading configurations within each group lying side-by-side.

To assist in producing the required illumination patterns, the reflector may also have at least one offset portion having the shape of a part of a paraboloid whose focus is displaced from the focus of the basic paraboloidal shape of the reflector. The offset portion or portions may, if required, be provided with one or more of the light-spreading configurations.

As indicated above, the invention is particularly applicable to headlamps for motor vehicles. Thus, according to a second aspect, the invention resides in the provision, in a headlamp for a motor vehicle, which headlamp is of the type comprising a reflector having a generally concave reflecting surface whose general shape is defined by the revolution of a parabola about an axis coinciding with the axis of symmetry of the parabola, and a front glass secured to the reflector to define, with the reflector, an enclosure within which two light sources are mounted, these two light sources comprising a main-beam filament mounted to the rear of the focus of the general shape of the reflecting surface, and a dipped-beam filament mounted forward of the said focus, of the improvement comprising:

providing on the reflecting surface of the reflector at least one light-spreading configuration, the light-spreading configuration occupying a relatively narrow, elongate area of the reflecting surface, and having a cross-section, when seen as intersected at any position along the length of the said configuration by a plane lying parallel to the said axis and transverse to the length of the light-spreading configuration, which cross-section deviates from the general shape of the reflecting surface, to provide reflecting surface portions which reflect light from the light sources in various directions angularly spaced apart from one another in a direction transverse to the length of the light-spreading configuration.

Other aspects and features of the invention will become clear from a study of the following description, taken in conjunction with the accompanying drawings.

BRIEF DESCRIPTION OF THE DRAWINGS

FIG. 7 is a diagrammatic view, similar to FIG. 3*d*, but showing a modified form of reflector.

DETAILED DESCRIPTION OF THE PREFERRED EMBODIMENTS

Figure 1:
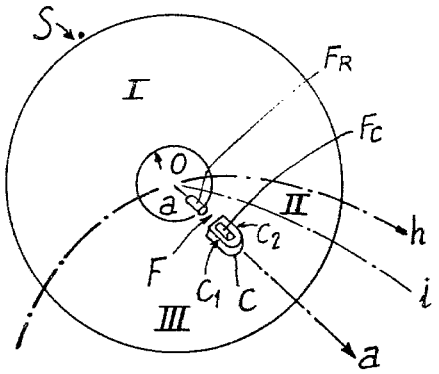
FIG. 1 is a somewhat diagrammatic perspective view, showing a conventional arrangement of certain parts of a headlamp, namely, a reflector, a dipped-beam lamp filament, and a main-beam lamp filament.

The conventional arrangement shown in FIG. 1 includes a reflector S, whose reflecting surface is a parabolic surface of revolution about an axis a—a and having a focus F; an aperture O at the apex of the reflector S accommodates the base of a twin-filament lamp, of which only the filaments are shown, at $F_R$ and $F_C$. The filament $F_R$ is a main-beam filament, and is of cylindrical overall shape, with its axis lying along the axis a—a, slightly behind the focus F; the filament $F_C$ is a dipped-beam filament, and is also of cylindrical overall shape, with its axis along the axis a—a, but is positioned slightly forward of the focus F. The dipped-beam filament $F_C$ is partly surrounded by a shield C, having two edges $C_1$ and $C_2$, parallel to the axis a—a, which define the cut-off of the dipped beam.

In any practical construction, the headlamp would also include a front glass closing the reflector S. Such a front glass is diagrammatically indicated at G in FIG. 3*c;* the other features shown in FIG. 3*c* will be mentioned later. As will become clear, both surfaces of the front glass G are smooth, since the front glass G is not required to deflect the light rays reflected from the reflector S. For this reason, no further reference will be made to the front glass G.

Figure 1A:
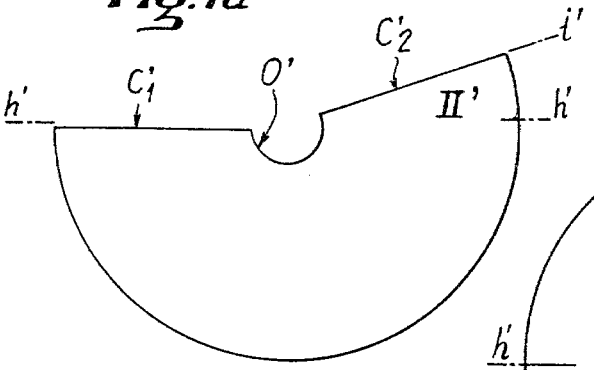
FIGS. 1*a* and 1*b* illustrate the areas of illumination which will be produced on a screen in front of the headlamp by the arrangement of FIG. 1, using the dipped-beam and main-beam filaments respectively.
Figure 1B:
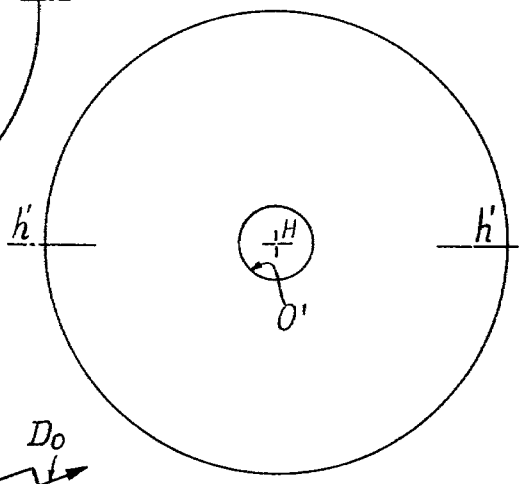

FIGS. 1*a* and 1*b* illustrate the projection of the resulting beams on to a screen. On this screen, H (FIG. 1*b*) is the projection of the axis a—a. FIG. 1*a* shows the area illuminated by the dipped beam; the cut-off limits $C'_1$ and $C'_2$ of this area are defined by the two edges $C_1$ and $C_2$ respectively of the shield C. The central part of the beam has a "black hole" O′ corresponding to the reflector aperture O.

FIG. 1*b* shows the projection of the main beam on to a screen. The illuminated area forms a completely circular pattern, since the main-beam filament $F_R$ has no shield. This beam also has a black hole O′ corresponding to the aperture O.

The reflector S may be notionally divided into three zones, as shown in FIG. 1. A first zone I is formed by the top half of the reflector, above the horizontal plane h—h passing substantially through its axis a—a. A second reflector zone II is formed by a sector in the right-hand part of the reflector (as seen by a person facing the front of the reflector), the sector being bounded on top by the horizontal plane h—h and on its lower edge by a cut-off half-plane i, which contains the axis a—a, and is inclined downards to the right (e.g. by about 15°). The third zone III occupies the rest of the lower part of the reflector. The main beam is formed by all three zones of the reflector together, while the dipped beam is formed solely by the zones I and II, the zone II reflecting those rays which produce the top part II′ of the beam (above the half-plane i′ in FIG. 1*a*).

Figure 2A:
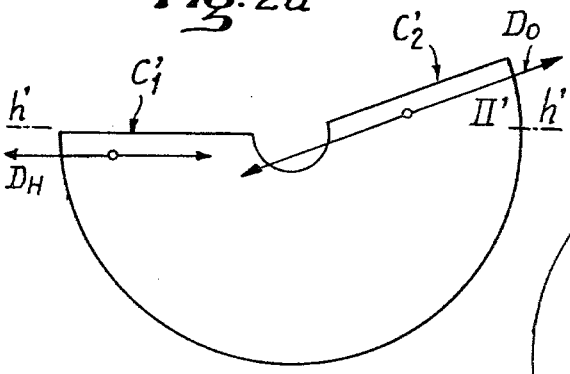
FIGS. 2*a* and 2*b* are views, similar to FIGS. 1*a* and 1*b*, but showing in addition how it is desired to modify the illumination patterns.

To produce satisfactory dipped and main beams, it is desirable to modify somewhat the illumination patterns shown in FIGS. 1*a* and 1*b;* the desired modifications will be discussed with reference to FIGS. 2*a* and 2*b*.

With regard to the dipped beam (FIG. 2*a*), a satisfactory beam, that is to say, one in which the black hole O′ is eliminated, can be obtained if the beam, especially in its left-hand part, can be given a horizontal spread, represented by arrows DH, and if its top right-hand part can also be given an oblique spread, represented by arrows DO.

With regard to the main beam (FIG. 2*b*), an improved beam will be produced if the rays of light in the zone III′ can be deflected radially towards the black hole O′, as shown by arrows R. It will also be seen that the oblique spreading DO defined above can be likened to a radial deflection (in the direction of the axis a—a).

To produce the desired modifications of the illumination patterns, the preferred form of reflector is still basically paraboloidal in shape, but departs from the true paraboloidal shape in two respects, namely, the provision of ribs on the reflector, which spread the light rays, as indicated by the arrows DH and DO, and the provision of portions which are still paraboloidal, but differ from the basic paraboloid, so that the light is reflected in a slightly different direction.

Figure 3A:
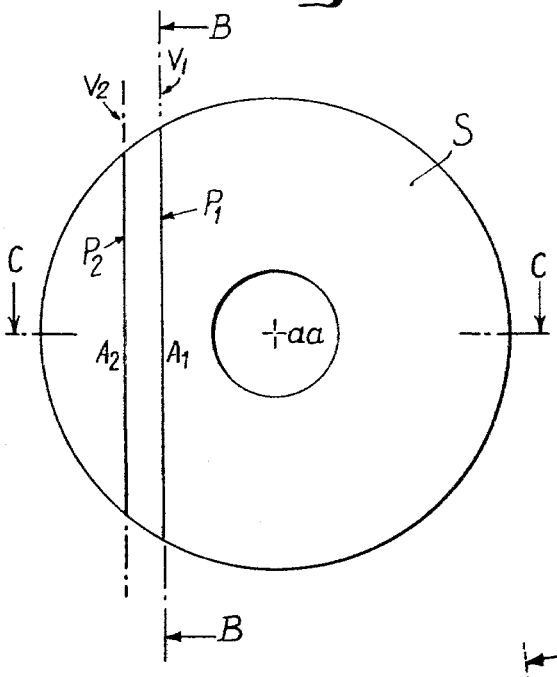
FIG. 3*a* is a diagrammatic front view of the reflecting surface of a reflector having a rib on its surface.
Figure 3B:
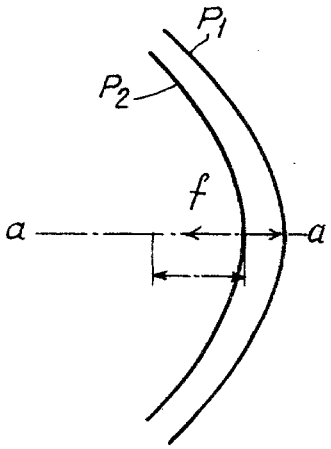
FIG. 3*b* is a section on the line B—B in FIG. 3*a;*
Figure 3D:
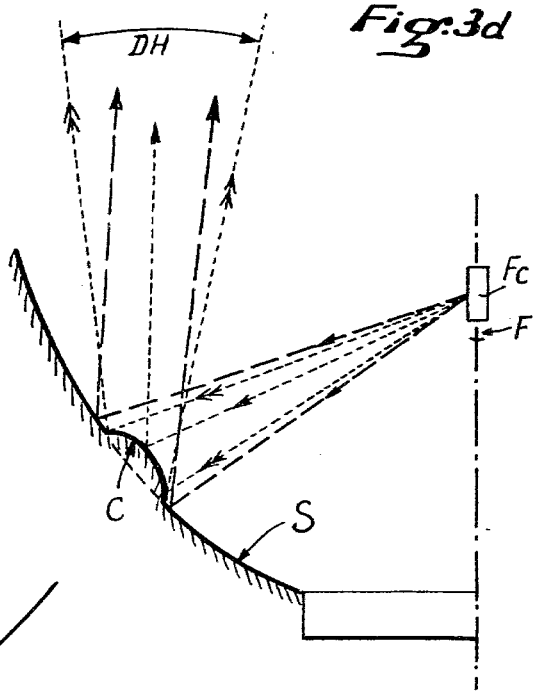
FIG. 3*d* corresponds to part of FIG. 3*c*, shown to an enlarged scale.
Figure 3C:
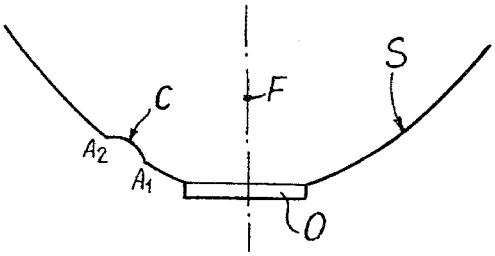
FIG. 3*c* is a section on the line C—C in FIG. 3*a* (horizontal section)

Dealing first with the reflector ribs, it will now be described, with reference to FIGS. 3*a* to 3*d*, how such ribs are used to produce the horizontal deflection DH, although of course a deflection can be obtained in any direction by changing the direction of the reflector rib. FIGS. 3*a* to 3*d* show a single rib, as an example. This horizontal-deflection reflector rib lies between the two lines in which the basic paraboloidal shape intersects two parallel vertical planes $V_1$ and $V_2$, parallel to but spaced from the axis a—a. These lines are shown at $P_1$ and $P_2$ in FIG. 3*b*, and are both parabolae having the same focal length f as the basic paraboloid. If, in the axial horizontal plane C—C (FIG. 3*c*), the surface of the rib follows a curve c from a point $A_1$ of parabola $P_1$ to a point $A_2$ of parabola $P_2$, then in all the horizontal planes parallel to C—C it is possible to arrange that the surface of the rib follows a curve of the same shape from parabola $P_1$ to parabola $P_2$. The curve c may, for example, be a circular arc of small radius, forming a raised portion, proud of the parabolic reference surface (FIG. 3*c*).

In other words, the reflector rib according to the invention is generated by the horizontal curved arc c moving, while always remaining horizontal, with its two ends always in contact with the two parabolae $P_1$ and $P_2$ corresponding to the intersection of the basic parabolic surface with the two vertical planes $V_1$ and $V_2$. The surface of the reflector rib is therefore a surface whose curved directrix is an arc such as c and whose generatrices are parabolae such as $P_1$ and $P_2$.

It will readily be seen (FIG. 3*d*) that the presence of a raised rib of section c on the reflecting surface S produces—as compared with the reflecting properties of the basic parabolic surface S—a horizontal light-spreading effect perpendicular to the general direction of the rib. This spreading is substantially the same in all the horizontal planes. FIG. 3*d* shows the path of the horizontal rays of light from the dipped-beam filament $F_c$; the beam incident on the rib is reflected with a horizontal spread DH.

A rib of this kind allows the light to be spread in any selected direction, the spreading being perpendicular to the general direction of the rib.

It should also be noted that it is very simple to produce a rib of this kind; a cutting tool having a profile corresponding to the arc c is simply traversed over a conventional male parabolic mould, corresponding to the basic paraboloidal surface S, with the tool following a path corresponding to the parabolae $P_1$ and $P_2$, so that the two ends of the arc c always lie on the parabolic surface.

Figure 4:
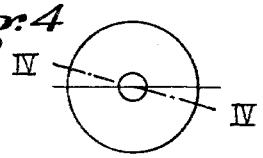
FIG. 4 is a diagrammatic front view of a reflector, showing the position of a section line IV—IV.
Figure 4A:
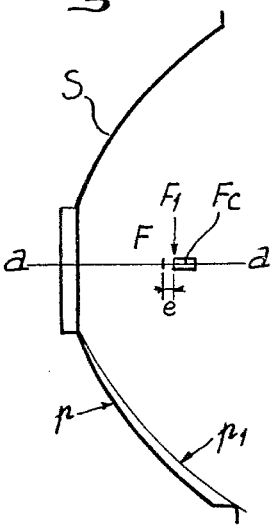
FIGS. 4*a*, 4*b*, and 4*c* are sections through three different headlamp reflectors, all taken on section lines in the position IV—IV of FIG. 4.
Figure 4B:
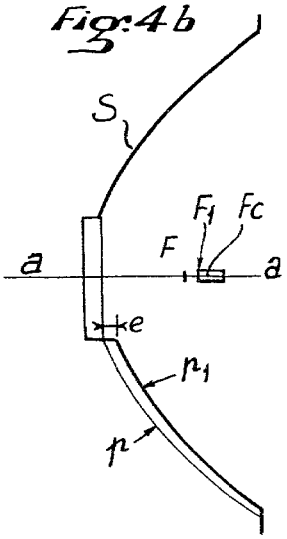
Figure 4C:
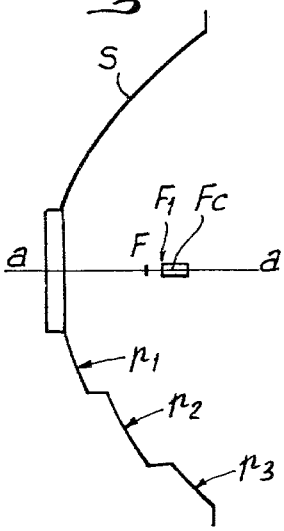

Dealing now with the provision of portions which are modified, but still paraboloidal, it will now be described, with reference to FIGS. 4*a*, 4*b* and 4*c*, how such portions are used to produce the deflection shown at DO in FIG. 2*a*. FIGS. 4*a*, 4*b* and 4*c* illustrate three different embodiments which will produce this deflection. The basic parabolic surface S taken as reference has its focus point at F, slightly rearwards of the rear end of the dipped-beam filament $F_c$. To achieve the deflection DO, the modified portions of the reflector S must be such that their focus comes to $F_1$ near the rear part of the dipped-beam filament $F_c$, at a distance e from F. When this condition is fulfilled, the light emitted from the rear part of the filament $F_c$ and reflected by the modified portions will fill the black hole O'.

In the case of FIG. 4*a*, the portion concerned, which is the sector II shown in FIG. 1, is modified by changing its focal length. The basic parabolic surface corresponding to a parabola p of focal length f and focus point F is replaced by another parabolic surface $P_1$ having the same apex and having the focal length f+e, so that the focus is at $F_1$.

In the case of FIG. 4*b*, the modified sector of the paraboloid is shifted uniformly forwards by an amount e parallel to the axis a—a, so that it occupies a position $p_1$, with its focus at $F_1$.

In the reflector illustrated in FIG. 4*c*, the sector II is formed by three separate paraboloidal portions $p_1$, $p_2$ and $p_3$, which are separated by steps, and each of which has its focus at $F_1$.

Figure 2B:
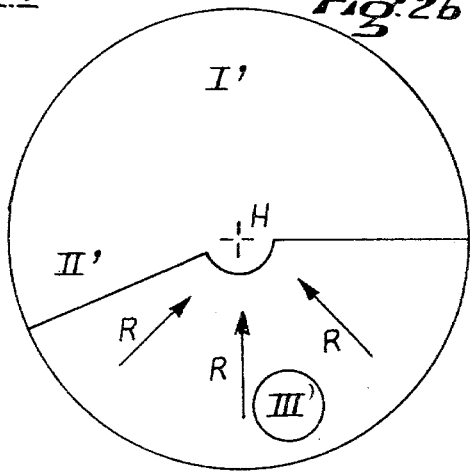
Figure 5:
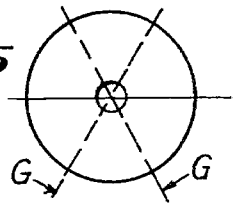
FIG. 5 is a diagrammatic front view of a reflector, showing the positions of two section lines G,G.
Figure 5A:
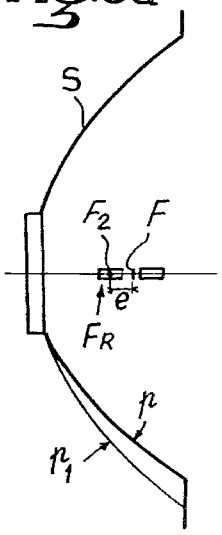
FIGS. 5*a*, 5*b* and 5*c* are sections through three different reflectors, all taken on section lines in one of the positions G,G of FIG. 5.
Figure 5B:
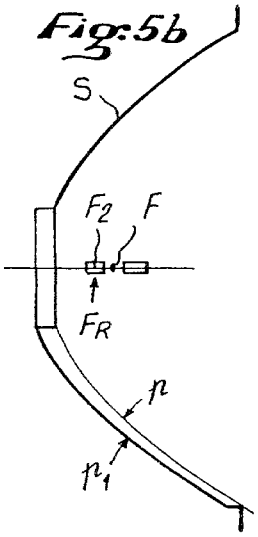
Figure 5C:
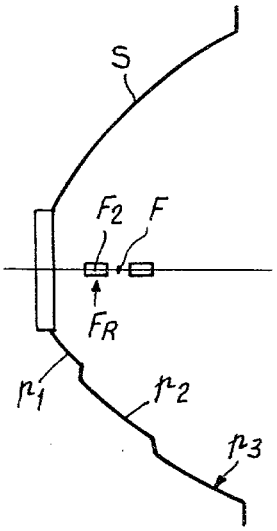

FIGS. 5*a*, 5*b* and 5*c* show how, in a similar manner, the sector III of the reflector may be modified in different ways to produce the change shown at R in the main-beam illumination pattern of FIG. 2*b*. As in FIGS. 4*a*, 4*b* and 4*c*, the basic paraboloidal shape is in each case replaced by one or more paraboloidal portions having their focus displaced by a distance e from the main focus F; to produce the required change R, the focus should coincide with the centre of the mainbeam filament $F_r$. By such an arrangement, the image of the main-beam filament projected on a screen by reflection from any part of the region III will be centred on the point H, at the centre of the previously-present black hole O'.

In the embodiment shown in FIG. 5*a*, the sector III is formed by a paraboloid having a parabolic generatrix $p_1$, the apex of which is the same as that of the parabola p of the basic parabolic reference surface but the focal length of which is (f−e), so that the focus of the segment concerned is at the centre of the filament $F_r$.

In the case of FIG. 5*b*, the sector III is formed by a paraboloid $p_1$ of the same focal length as the basic paraboloid p, but shifted rearwards by a distance e.

In the case of FIG. 5*c*, three separate paraboloidal portions p1, p2, and p3 are provided in the sector III; the portions $p_1$, $p_2$ and $p_3$ are separated by steps, and have their foci situated at F2, at the centre of the main-beam filament $F_r$.

Figure 6:
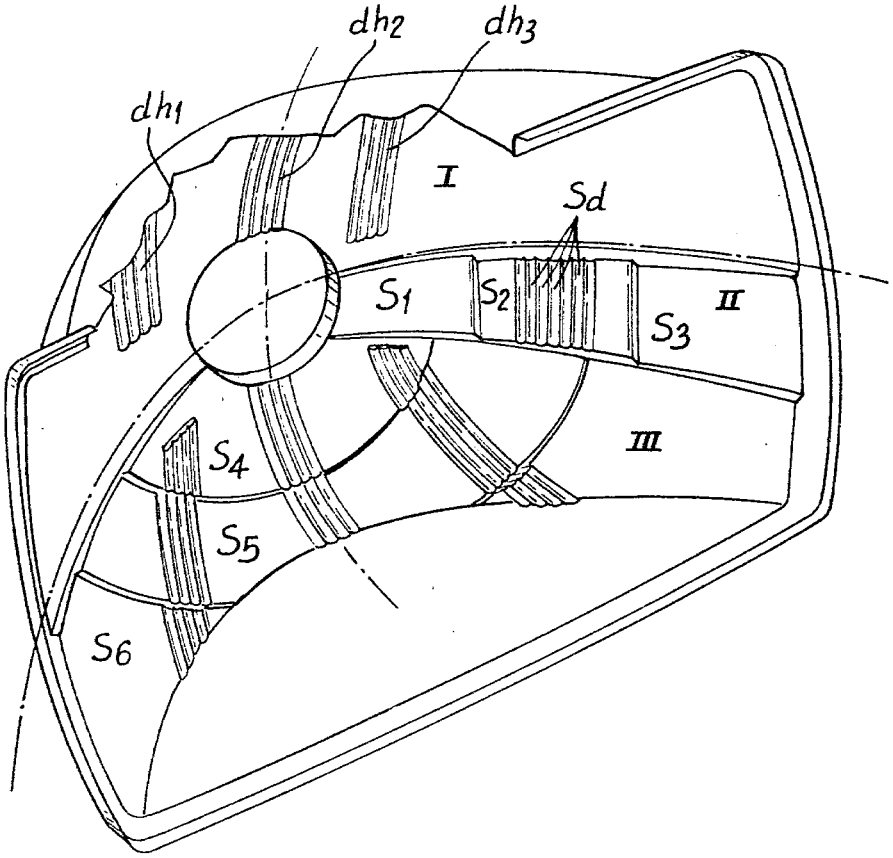
FIG. 6 is a front perspective view, partially broken away, of a reflector embodying the invention.

Of course, both forms of modifications of the reflector (ribs, and modified paraboloidal portions) can be used simultaneously to combine their effects. For example there may be reflector ribs on paraboloidal portions which are offset from the basic paraboloid. FIG. 6 shows an embodiment of this kind. This is a front view of a reflector, the top zone I of which has three groups of ribs $dh_1$, $dh_2$ and $dh_3$, each producing a horizontal spreading of the headlamp beam.

The zone II consists of three offset paraboloidal segments S1, S2 and S3. The segment S2 has light-spreading ribs Sd. In this case the segments and the ribs cooperate together to produce the deflection indicated at DO in FIG. 2*a*.

The zone III of the reflector has offset paraboloidal segments S4, S5 and S6, and also has light-spreading ribs. Here again the offset segments and the ribs cooperate to produce the deflection indicated at R in FIG. 2*b*.

Of course the preferred embodiment described is only one specific example. The invention can be embodied in various other ways. For example, as FIG. 7 shows, grooves T, having a cross-section which is concave towards the light sources $F_c$ and $F_r$ may be used instead of the ribs C. Such grooves, if suitably designed, can still produce the spreading of the light rays, as indicated at DH'.

It may also be possible to use the reflector ribs alone, in the case in which a single lateral (and not radial) deflection of the images is sufficient to give a satisfactory beam. Also, the limits of each rib are preferably defined by the intersection of the basic paraboloidal surface with two adjacent parallel planes, but it may alternatively be defined by the intersection of the basic surface with any two adjacent surfaces, not necessarily planar, which are spaced apart by a generally constant distance along the rib.

Finally it should be noted that reflector ribs of the type described above produce not only a lateral light-spreading effect in one plane direction, but also have the effect of producing a spreading of the rays of light at right angles to this plane direction. Such an effect is specific to the use of reflector ribs; it cannot be obtained with ribs on the headlamp lens.

What I claim:

1. A motor vehicle headlamp, comprising:

a generally parabolic reflector having a generally concave reflecting surface, the general shape of the reflector having a focus, a lens in front of the reflecting surface and cooperating with the reflector to define an enclosure, and a light source within the enclosure for emitting light which is directed in a generally forward direction by the reflecting surface, the reflecting surface of the reflector having a modified portion which is of generally parabolic shape, the focus of the modified portion being spaced from the focus of the general shape of the reflector, and the modified portion of the reflecting surface having a generally vertical reflecting rib, the transverse cross-sectional shape of the rib being convex.

2. A motor vehicle headlamp as defined in claim 1 wherein the modified portion of the reflecting surface has a plurality of parallel vertical reflecting ribs, the transverse cross-sectional shape of each rib being convex.

3. A motor vehicle headlamp as defined in claim 1 wherein the reflecting surface of the reflector has a number of spaced apart groups of reflecting ribs, each group including a plurality of parallel vertical ribs, the transverse cross-sectional shape of each rib being convex, and one of the groups of ribs being located on the modified portion of the reflecting surface.

4. A motor vehicle headlamp as defined in claim 1 wherein the reflecting surface of the reflector has a plurality of modified portions each of which is of generally parabolic shape, the focus of each modified portion being spaced from the focus of the general shape of the reflector, at least one of the modified portions having a generally vertical reflecting rib, the transverse cross-sectional shape of the rib being convex.

5. A motor vehicle headlamp as defined in claim 4 wherein more than one of the modified portions have generally vertical reflecting ribs, the transverse cross-sectional shape of each rib being convex.

6. A motor vehicle headlamp as defined in claim 1 wherein the focus of the modified portion is spaced in front of the focus of the general shape of the reflector along the axis of the general shape of the reflector.

7. A motor vehicle headlamp as defined in claim 1 wherein the focus of the modified portion is spaced behind the focus of the general shape of the reflector along the axis of the general shape of the reflector.

8. A motor vehicle headlamp as defined in claim 1 wherein the light source has a main beam filament, spaced behind the focus of the general shape of the reflector, and a dipped beam filament, spaced in front of the focus of the general shape of the reflector, the focus of the modified portion of the reflecting surface being closer to the main beam filament than is the focus of the general shape of the reflector.

9. A motor vehicle headlamp as defined in claim 8 wherein the modified portion is in the lower part of the reflecting surface.

10. A motor vehicle headlamp as defined in claim 1 wherein the light source has a main beam filament, spaced behind the focus of the general shape of the reflector, and a dipped beam filament, spaced in front of the focus of the general shape of the reflector, the focus of the modified portion of the reflecting surface being closer to the dipped beam filament than is the focus of the general shape of the reflector.

11. A motor vehicle headlamp as defined in claim 10 wherein the modified portion is in the lower part of the reflecting surface.

12. A motor vehicle headlamp as defined in claim 1 wherein the lens has smooth front and rear surfaces.

* * * * *